US007472442B2

(12) United States Patent
Mossbeck

(10) Patent No.: US 7,472,442 B2
(45) **Date of Patent: *Jan. 6, 2009**

(54) GAS SPRING ACTIVATED ADJUSTABLE BED

(75) Inventor: Niels S. Mossbeck, Carthage, MO (US)

(73) Assignee: L&P Property Management Company, South Gate, CA (US)

( * ) Notice: Subject to any disclaimer, the term of this patent is extended or adjusted under 35 U.S.C. 154(b) by 258 days.

This patent is subject to a terminal disclaimer.

(21) Appl. No.: 11/460,714

(22) Filed: Jul. 28, 2006

(65) Prior Publication Data

US 2006/0260052 A1 Nov. 23, 2006

Related U.S. Application Data

(63) Continuation of application No. 10/930,090, filed on Aug. 31, 2004, now Pat. No. 7,134,156, and a continuation-in-part of application No. 10/910,061, filed on Aug. 3, 2004, now Pat. No. 7,093,312.

(51) Int. Cl.
*A47B 7/02* (2006.01)

(52) U.S. Cl. ..... 5/618; 5/617

(58) Field of Classification Search ..... 5/613, 5/614, 616–618

See application file for complete search history.

(56) References Cited

U.S. PATENT DOCUMENTS

| | | | | |
|---|---|---|---|---|
| 2,560,465 | A | 7/1951 | McVicker et al. | |
| 3,127,783 | A | 4/1964 | Martens | |
| 3,261,639 | A | 7/1966 | Phillips | |
| 3,317,931 | A * | 5/1967 | Benoit et al. | 5/616 |
| 3,821,821 | A | 7/1974 | Burst et al. | |
| 4,385,410 | A | 5/1983 | Elliott et al. | |
| 4,559,655 | A | 12/1985 | Peck | |
| 5,105,486 | A | 4/1992 | Peterson | |
| 5,165,129 | A | 11/1992 | Rohm | |
| 5,640,730 | A | 6/1997 | Godette | |
| 6,000,077 | A | 12/1999 | Cyr | |
| 6,088,853 | A | 7/2000 | Jansen | |
| 6,209,157 | B1 | 4/2001 | Hensley | |
| 6,230,346 | B1 | 5/2001 | Branson et al. | |
| 6,276,011 | B1 | 8/2001 | Antinori | |
| 6,351,861 | B1 | 3/2002 | Shows et al. | |
| 6,389,622 | B1 * | 5/2002 | Her et al. | 5/600 |
| 6,393,641 | B1 | 5/2002 | Hensley | |
| 6,462,500 | B1 | 10/2002 | L'Hegarat et al. | |
| 6,499,162 | B1 * | 12/2002 | Lu | 5/618 |

(Continued)

OTHER PUBLICATIONS

McMaster-Carr Supply Company, www.mcmaster.com, four pages.

*Primary Examiner*—Patricia L Engle
*Assistant Examiner*—Jonathan J Liu
(74) *Attorney, Agent, or Firm*—Wood, Herron & Evans LLP

(57) ABSTRACT

An adjustable bed including a stationary frame is supported above a floor. An articulated deck comprising head, seat, leg and foot deck boards hingedly joined together is spaced above the frame with connectors. The connectors include generally inverted U-shaped tubes pivotally secured to the frame and secured to the deck boards. A gas spring is operatively coupled to the head deck board and pivotally secured to the frame. Activation of the gas spring in cooperation with the operator moves the deck boards.

16 Claims, 4 Drawing Sheets

U.S. PATENT DOCUMENTS

| | | | | |
|---|---|---|---|---|
| 6,640,365 | B1 | 11/2003 | Chang | |
| 6,643,873 | B2 * | 11/2003 | Heimbrock et al. | 5/618 |
| 6,739,004 | B1 | 5/2004 | Abrahamsen et al. | |
| 6,789,280 | B1 * | 9/2004 | Paul | 5/617 |
| 6,839,926 | B2 | 1/2005 | Heimbrock et al. | |
| 6,907,631 | B2 | 6/2005 | Heaton | |
| 6,957,460 | B2 | 10/2005 | Horitani | |
| 6,961,971 | B2 | 11/2005 | Schneider et al. | |
| 7,134,156 | B2 * | 11/2006 | Mossbeck | 5/618 |
| 2002/0178502 | A1 | 12/2002 | Beasley et al. | |

* cited by examiner

GAS SPRING ACTIVATED ADJUSTABLE BED

CROSS REFERENCE TO RELATED APPLICATIONS

This application is a continuation of U.S. patent application Ser. No. 10/930,090 entitled "Gas Spring Activated Adjustable Bed" filed Aug. 31, 2004. U.S. patent application Ser. No. 10/930,090 is a continuation-in-part of U.S. patent application Ser. No. 10/910,061 entitled "Single Motor Adjustable Bed" filed Aug. 3, 2004. Both of these applications are fully incorporated herein.

FIELD OF THE INVENTION

This invention relates generally to adjustable beds and, more particularly, to an adjustable bed having a drive assembly incorporating a gas spring.

BACKGROUND OF THE INVENTION

A well known type of bedding product comprises a motorized adjustable bed in which an articulated frame supports a mattress. These motorized adjustable beds have traditionally been used in hospitals but more and more are being installed and used in residential homes. Motorized articulated beds have conventionally had an upper body support movable between an inclined position in which it supports the patient in a sitting position and a prone position in which the patient lies down in a generally horizontal position. In addition, a leg support is movable between positions and may be adjusted to a desired degree of inclination. An actuating mechanism, commonly two or more electric motors, raises and lowers the head and leg supports of the articulated bed frame. U.S. Pat. No. 5,640,730 discloses such an articulated bed. Disadvantages of adjustable beds incorporating two electric motors over adjustable beds having only one electric motor include 1) the odds of at least one of the motors malfunctioning increases and 2) increased manufacturing costs.

In order to reduce the manufacturing costs of an adjustable bed, adjustable beds have been made with a single motor. U.S. Pat. Nos. 4,385,410 and 4,559,655 disclose such adjustable beds powered by a single motor. Known adjustable beds powered by a single motor require a great deal of power to raise and lower the bed sections to their desired positions due to the weight of the person lying on the bed.

U.S. Pat. Nos. 6,499,162 and 6,640,365 disclose adjustable beds comprising a plurality of bedplates pivotally secured together for supporting a mattress. Connecting elements or links pivotally connect a base to the bed plates. Activation of a power source such as an electric motor causes movement of the bed plates. One disadvantage with the adjustable beds is that the bedplate above the seat of the user does not lower. Consequently, the weight of the person using the bed is not used to move the bedplates.

Therefore, there is a need for an articulated bed powered by a driver which utilizes a person's weight to help activate the bed.

SUMMARY OF THE INVENTION

This invention comprises an adjustable bed having an adjustable deck for supporting a mattress. The adjustable bed is powered in part by a driver which preferably is a gas spring. However, any other driver or drive assembly, such as a solenoid, may be used in accordance with the present invention.

The adjustable bed comprises a base comprising a stationary frame and legs extending downwardly from the stationary frame to support the frame a fixed distance above the floor or supporting surface. Although legs are preferable, other types of supports may be used in accordance with the present invention to raise the frame off the supporting surface. The frame is generally rectangular having a pair of side rails and a pair of opposed end rails including a head rail and a foot rail at the head and foot ends of the adjustable bed, respectively.

An articulated deck for supporting a mattress is spaced above the frame with a plurality of connectors. The articulated deck comprises a head deck board, a seat deck board, a leg deck board and a foot deck board hingedly joined to each other. In accordance with the present invention, the articulated deck may comprise any number of deck boards.

The connectors are pivotally secured to the side rails of the frame. More specifically, a pair of generally inverted U-shaped seat tubes or connectors pivotally secured to the side rails of the frame are secured to the seat deck board of the articulated deck. Similarly, a pair of generally inverted U-shaped foot tubes or connectors pivotally secured to the side rails of the frame are secured to the foot deck board of the articulated deck. Lastly, a head tube having an inverted U-shape is pivotally secured to the side rails of the frame and secured to the head deck board. However, any number of connectors of any suitable form may be used in accordance with the present invention.

A driver in the form of a gas spring is operatively coupled to the head deck board of the articulated deck. The driver, used in conjunction with the weight of the user, functions to move the articulated deck between a first horizontal position in which all of the deck boards are co-planar in a horizontal position and a second fully inclined position in which the head deck board is inclined, the seat deck board generally horizontal, the leg deck board inclined and the foot deck board slightly inclined.

The driver preferably comprises a gas spring pivotally secured to the frame of the articulated bed at one end and pivotally secured to a mounting bracket at the other end, the mounting bracket being secured to the head deck board. Activation of the gas spring moves the head deck board between its first horizontal position and its second inclined position.

In operation, starting from the first position of the articulated bed in which the articulated deck is generally horizontal, an operator activates the driver. The driver extends a piston rod from the cylinder of the gas spring. The piston rod of the driver rotates or pivots about a horizontal axis at the lower end of the piston rod i.e. where the piston rod is pivotally secured to the frame. Upon extension of the piston rod, the head deck board moves from its first horizontal position to its second inclined position. As the head deck board inclines, the seat deck board moves horizontally towards the head end of the bed and also lowers due in part to the connectors and more particularly, the tubes pivoting about horizontal pivot axes. The user or operator leans forward using his or her weight to help move the seat deck board downwardly and towards the head end of the bed. As the seat deck board moves downwardly and towards the head end of the bed, the leg deck board moves from its first horizontal position to its second inclined position. This movement of the leg deck board causes the foot deck board to move towards the head end of the bed as the connectors and in particular the foot tubes are pivoted about horizontal pivot axes.

The configuration of the articulated bed of the present invention allows a user to use his or her weight to move the articulated bed between a first horizontal or prone position to a second inclined position with the assistance of the driver of the articulated bed.

These and other objects and advantages of the present invention will be more readily apparent from the following drawings.

DETAILED DESCRIPTION OF THE DRAWINGS

Figure 1:
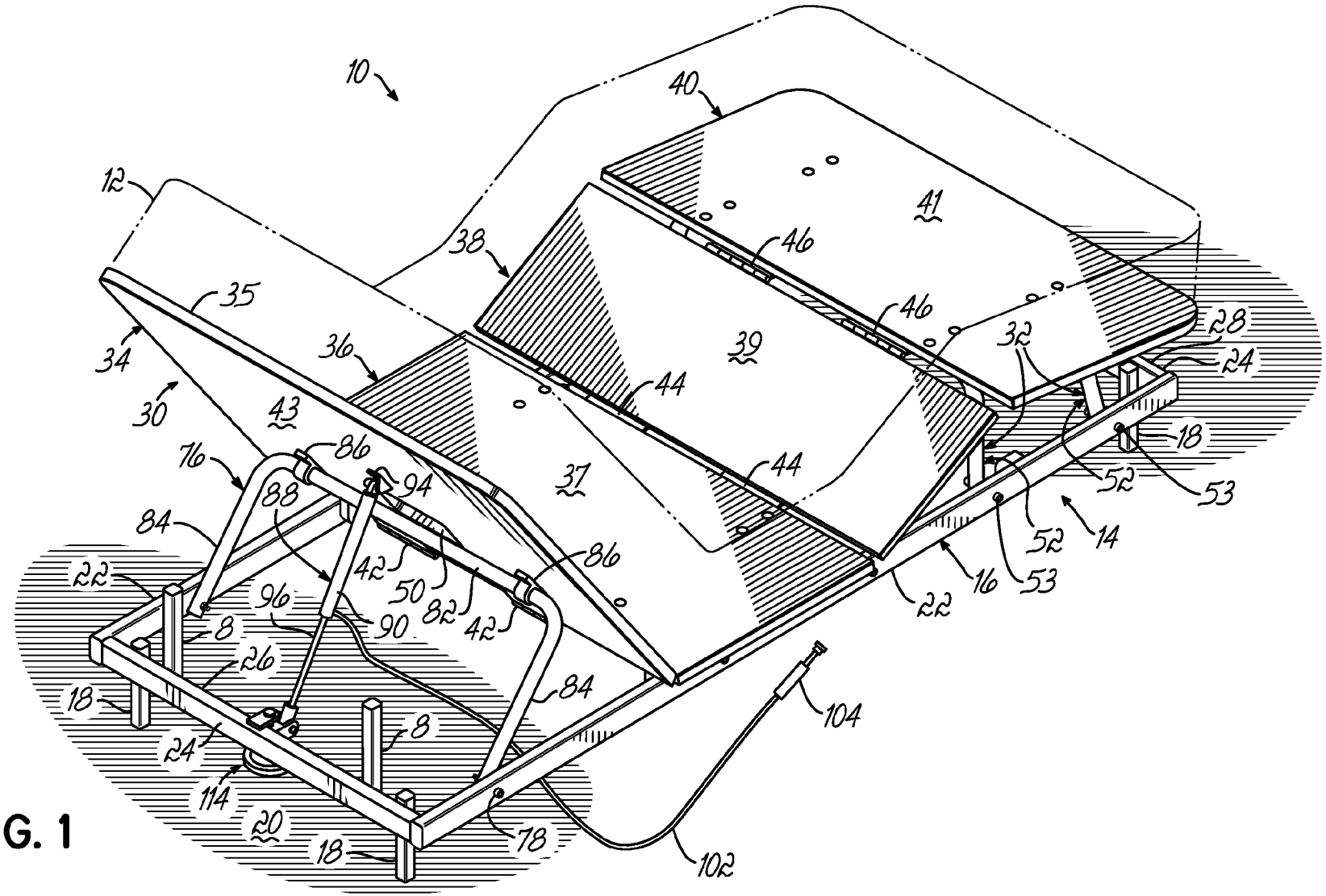
FIG. 1 is a perspective view of an adjustable bed made in accordance with this invention in a fully inclined position supporting a mattress shown in phantom.

Referring to the drawings, and particularly to FIG. 1, there is illustrated an adjustable bed 10 including a mattress 12. The present invention may be used to support any type of mattress including an air mattress, a coil spring mattress or any other type of mattress. The mattress 12 does not form a part of the present invention.

Figure 2:
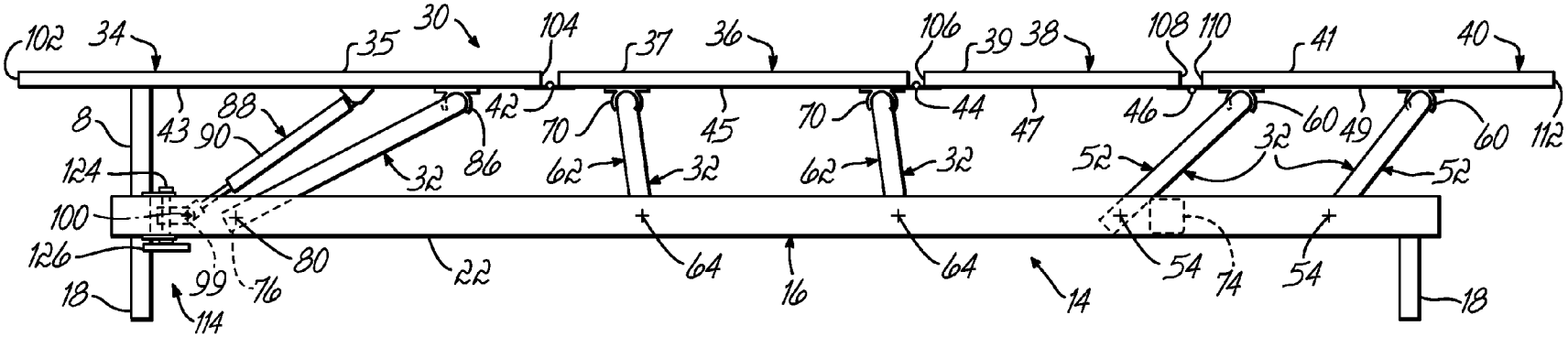
FIG. 2 is a side elevational view of the adjustable bed of FIG. 1 without the articulated deck in a horizontal position.
Figure 3:
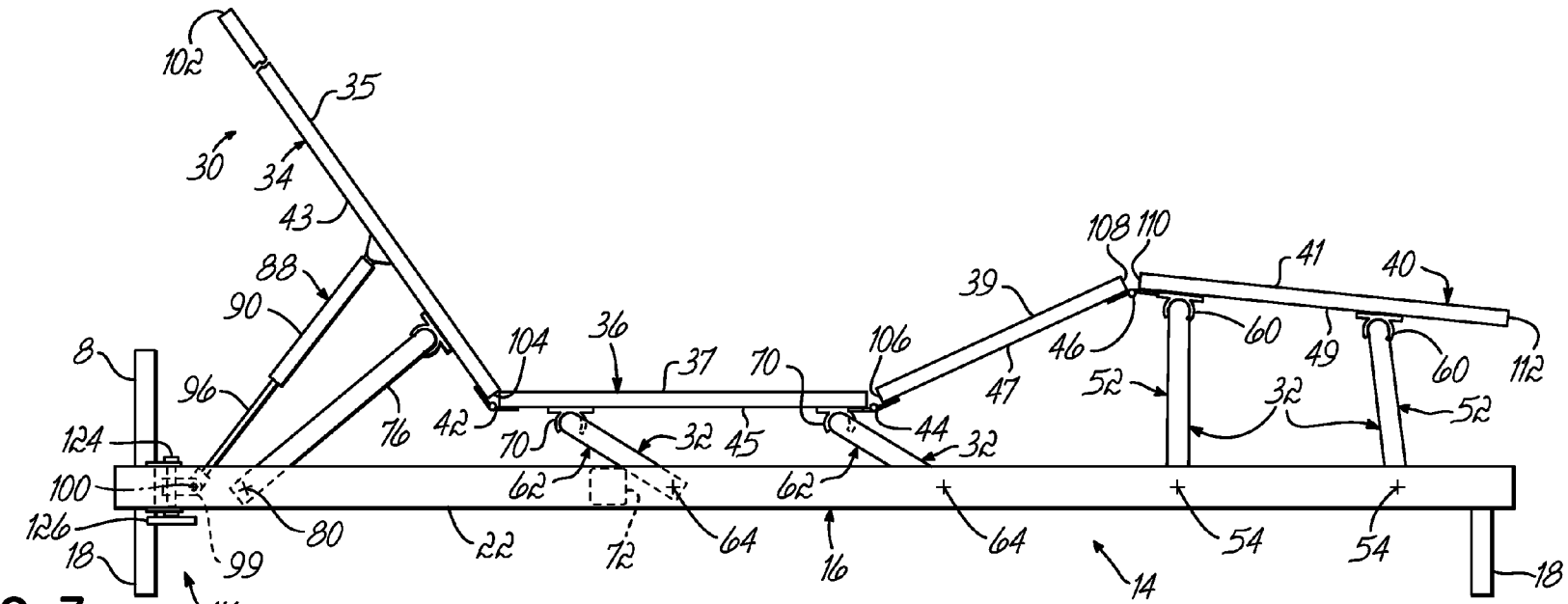
FIG. 3 is a side elevational view of the adjustable bed of FIG. 1 without the articulated deck in a fully inclined position.

The adjustable bed 10 is movable between a first horizontal position shown in FIG. 2 and a fully inclined position as shown in FIGS. 1 and 3. Typically, an operator or user sleeps with the adjustable bed in its first horizontal position and reads or watches television with the adjustable bed in its fully inclined position.

The adjustable bed 10 comprises a base 14 including a generally rectangular stationary frame 16 and four legs 18 supporting the frame 16 a fixed distance about a floor or supporting surface 20. See FIG. 1. The stationary frame 16 comprises a pair of opposed side rails 22 and a pair of opposed end rails 24 extending between the side rails 22 at the ends thereof. The end rails 24 include a head rail 26 and a foot rail 28. The legs 18 are preferably secured to the end rails 24 but may be secured to the side rails 22 if desired. Any other desired configuration of frame may be used, if desired.

An articulated deck 30 is spaced above the stationary frame 16 with a plurality of connectors 32. The articulated deck 30 comprises a head deck board 34, a seat deck board 36, a leg deck board 38 and a foot deck board 40. Each of the deck boards is preferably the same width but any two boards may be different widths, if desired. Deck boards 34, 36, 38 and 40 have upper surfaces 35, 37, 39 and 41, respectively, and lower surfaces 43, 45, 47 and 49, respectively.

Figure 4:
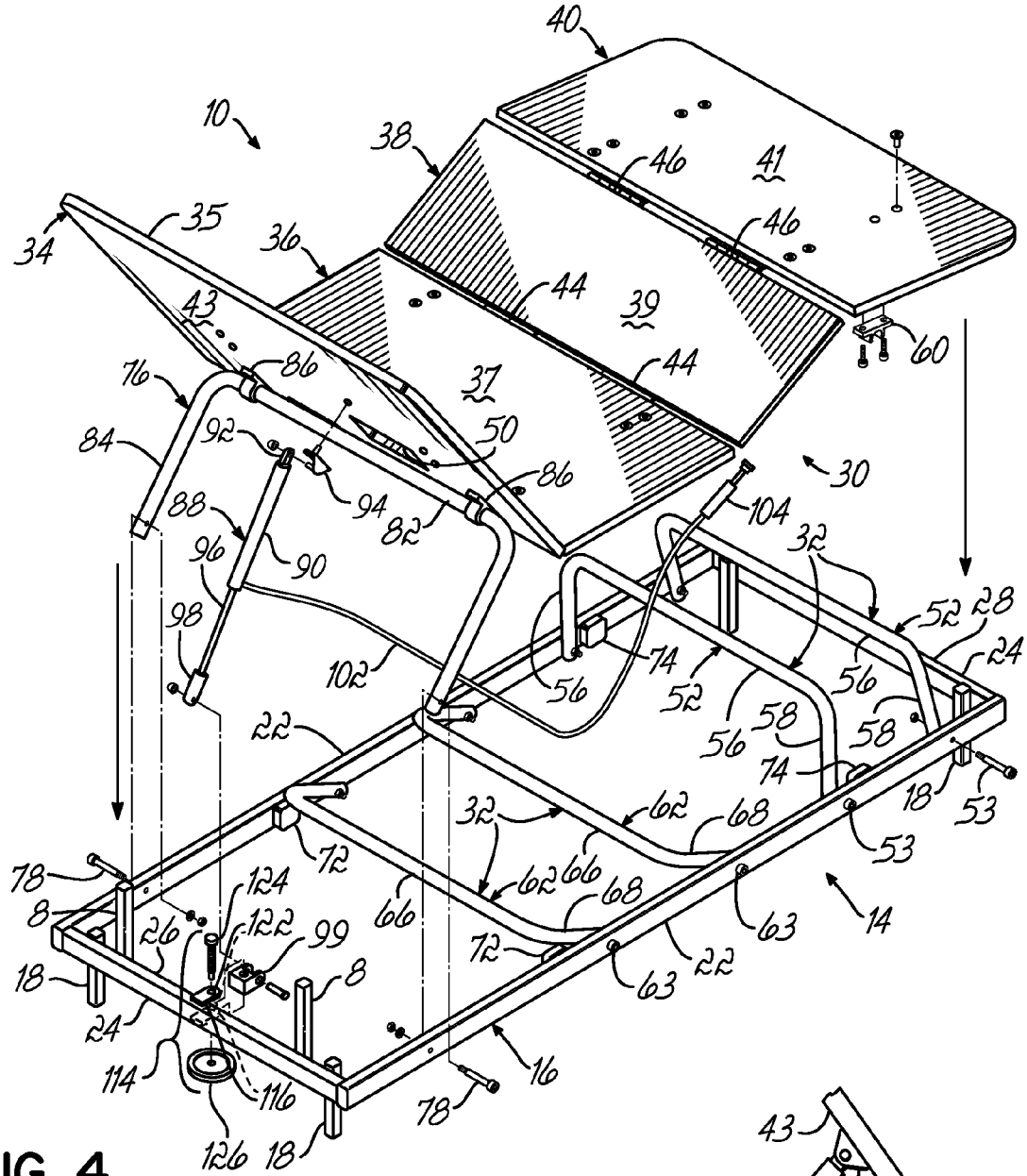
FIG. 4 is a disassembled perspective view of the adjustable bed of FIG. 1 without the mattress.

As best illustrated in FIGS. 2 and 3, the head deck board 34 is hingedly secured to the seat deck board 36 with hinges 42 secured to the lower surfaces 43, 45 of the head and seat deck boards 34, 36, respectively. Similarly, seat deck board 36 is hingedly secured to leg deck board 38 with hinges 44 secured to the lower surfaces 45, 47 of the seat and leg deck boards 36, 38, respectively. Leg deck board 38 is hingedly secured to foot deck board 40 with hinges 46 secured to the lower surfaces 47, 49 of the leg and foot deck boards 38, 40, respectively. Although, two hinges 42 are shown in FIGS. 1 and 4 securing the head deck board 34 to the seat deck board 36, any number of hinges may be used including one continuous hinge. The same applies to hinges 44 and 46 connecting the other deck boards.

The deck boards 34, 36, 38 and 40 are preferably made of plywood but may be made of plastic, oriented strand board or any other material.

As illustrated in FIGS. 1 and 4, the head deck board 34 has a rectangular hole 50 therein which may be used as a handle.

The adjustable bed 10 further comprises connectors 32 in the form of inverted U-shaped foot tubes 52. As shown in FIG. 4, the adjustable bed 10 has two foot tubes 52 pivotally secured to the side rails 22 of the stationary frame 16 with fasteners 53 so that each pivots about a horizontal pivot axis 54. Each foot tube 52 has a center portion 56 and a pair of leg portions 58 extending downwardly from opposed ends of the center portion 56. The center portion 56 of each of the foot tubes 52 is secured to the foot deck board 40 with clips 60. As shown in FIG. 4, a pair of clips 60 are secured to the lower surface 49 of the foot deck board 40. Although each foot tube 52 is illustrated being secured to two clips 60, any other means of securing the foot tubes 52 to the foot deck board 40 may be used.

Similarly, two seat tubes or connectors 62 are pivotally secured to the side rails 22 of the stationary frame 16 with fasteners 63 so that each pivots about a horizontal pivot axis 64. Each seat tube 62 has a center portion 66 and a pair of leg portions 68 extending downwardly from opposed ends of the center portion 66. The center portion 66 of each of the foot tubes 62 is secured to the seat deck board 36 with clips 70. As shown in FIGS. 2 and 3, a pair of clips 70 are secured to the lower surface 45 of the seat deck board 36. Although each seat tube 62 is illustrated being secured to two clips 70, any other means of securing the seat tubes 62 to the seat deck board 36 may be used.

As illustrated in FIG. 4, a pair of stops 72 is secured to the inside surfaces of the side rails 22 of the frame 16 to prevent the seat tubes 62 from moving too far forward i.e. towards the head end of the bed. Similarly, a pair of stops 74 is secured to the inside surfaces of the side rails 22 of the frame 16 to prevent the foot tubes 52 from moving too far rearward i.e. towards the foot end of the bed.

A head tube or connector 76 is pivotally secured to the side rails 22 of the stationary frame 16 with fasteners 78 so that each pivots about a horizontal pivot axis 80. As seen in FIGS. 1 and 4, the head tube 76, like the seat and foot tubes, has a center portion 82 and a pair of leg portions 84 extending downwardly from opposed ends of the center portion 82. The center portion 82 of the head tube 76 is secured to the head deck board 34 with clips 86. As shown in FIGS. 2 and 3, a pair of clips 86 are secured to the lower surface 43 of the head deck board 34. Although the head tube 76 is illustrated being secured to two clips 86, any other means of securing the head tube 76 to the head deck board 34 may be used.

The articulated deck 30 is moved by a driver in the form of a gas spring, in conjunction with the weight of the user, between a first retracted position shown in FIG. 2 in which the deck boards 34, 36, 38 and 40 are generally co-planar in a horizontal position or orientation and a second position shown in FIG. 3. In the second position, the head deck board 34 is inclined, the seat deck board 36 is substantially horizontal, the leg deck board 36 inclined and the foot deck board 40 slightly inclined.

When the articulated deck 30 is in its first horizontal position shown in FIG. 2, a pair of braces 8 secured to the head rail 26 of the frame 18 and extending upwardly therefrom supports the head deck board 34 of the articulated deck 30. See FIG. 2.

Figure 5:
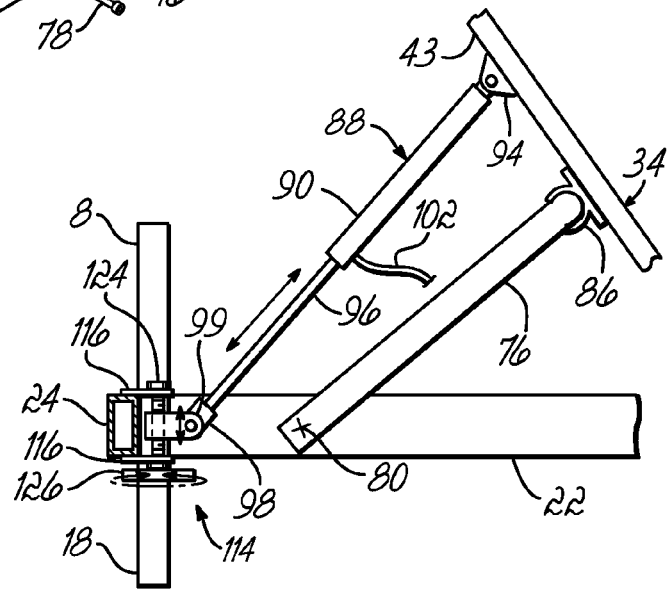
FIG. 5 is a side elevational view of a portion of the adjustable bed of FIG. 1.

The driver in the form of a gas spring 88, shown assembled in FIG. 1 and disassembled in FIG. 4, comprises a cylinder 90 pivotally secured at its upper end 92 to a mounting bracket 94 which is secured to the lower surface 43 of the head deck board 34. Moveable inside the cylinder 90 is a piston rod 96 which has a lower end 98 which is pivotally secured to a vertically adjustable bracket 99. The vertically adjustable bracket 99 is part of an adjustable mounting assembly 114 shown in detail in FIGS. 5 and 6. The adjustable mounting assembly 114 is fixed to the head end rail 24 of the stationary frame 16 such that the piston rod 96 pivots about a horizontal pivot axis 100. See FIGS. 2 and 3. Due to movement of the piston rod 96 inside the cylinder 90, the gas spring 88 is movable between a retracted position shown in FIG. 2 and an extended position shown in FIG. 3.

Figure 6:
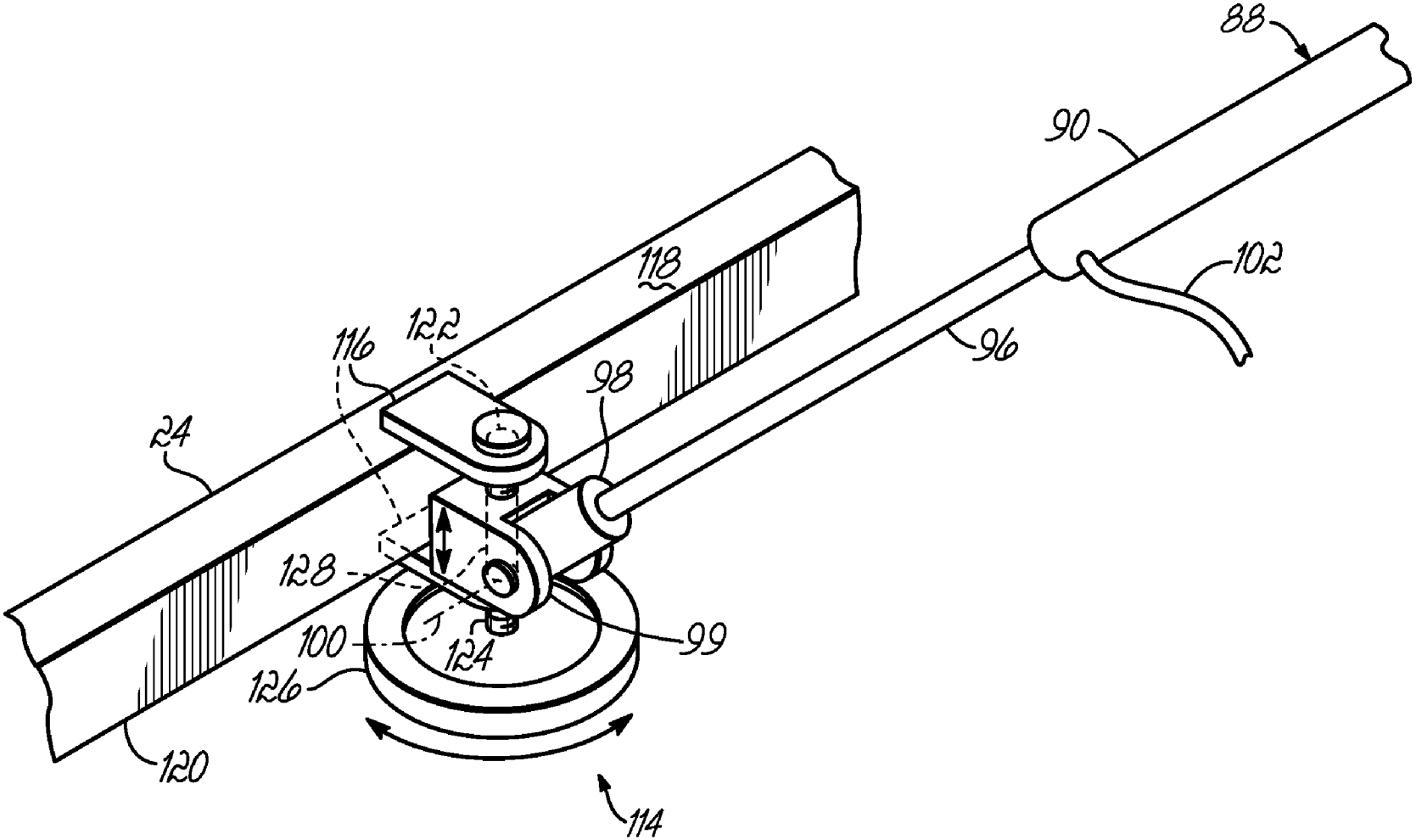
FIG. 6 is a perspective view of the adjustable mounting assembly of the adjustable bed of FIG. 1.

As shown in FIG. 6, the adjustable mounting assembly 114 comprises a pair of mounting brackets 116 secured to top and bottom surfaces 118, 120, respectively, of the head end rail 24. Each of the mounting brackets 116 has a hole 122 therein through which passes a threaded rod 124. At the lower end of the threaded rod 124 is a rotatable hand wheel 126 which rotates the threaded rod 124 when rotated. A movable bracket 99 is movable between the mounting brackets 116 via rotation of the threaded rod 124. More specifically, the movable bracket 99 has a threaded hole 128 through which the threaded rod 124 passes. When the threaded rod 124 is rotated via the hand wheel 126 or any other means such as a lever or handle, for example, the movable bracket 99 moves up or down depending upon the direction of rotation of the threaded rod 124.

In this manner, the pivot point along horizontal axis 100 may be adjusted upwardly or downwardly as desired. When the pivot axis 100 is up, a light weight person can more easily push the bed down to the horizontal position. When the pivot axis 100 is down, a heavier person can use his or her weight to more easily tilt the bed from a horizontal position to a fully inclined position. See FIG. 5. Thus, for a heavier person, it is advantageous to adjust the pivot axis 100 downwardly and for a lighter person it is advantageous to adjust the pivot axis 100 upwardly. If desired, the pivot axis 100 may be fixed at one location rather than being adjustable.

Although any gas spring may be used in accordance with the present invention, one which has proven suitable is available from McMaster-Carr Supply Company (www.mcmaster.com) under the model number 2692K1. Such a gas spring is able to provide 100 pounds of force to assist an operator to move the articulated bed to a desired position.

The gas spring 88 may be controlled by an actuator such as a lever (not shown), hydraulic means (not shown) or a cable 102 at the end of which is a cable release 104. Although any cable release may be used in accordance with the present invention, one which has proven suitable is available from McMaster-Carr Supply Company (www.mcmaster.com) under the model number 9684K15.

In operation, starting from the first position of the articulated bed 10 shown in FIG. 2 in which the articulated deck 30 is generally horizontal, an operator (not shown) activates gas spring 88 by pushing the cable release 104. Activation of the gas spring 88 extends the piston rod 96 from its retracted position inside the cylinder 90 which causes the head tube 76 to pivot about horizontal pivot axis 80, i.e. where the head tube 76 is secured to the side rails 22 of the stationary frame 18. At the same time the operator leans forwardly helping the head deck board 34 move from its first horizontal position shown in FIG. 2 to its second inclined position shown in FIG. 3 in which the head edge 102 of the head deck board 34 is above the rear edge 104 of the head deck board 34.

As the head deck board 30 inclines, the rear edge of the head deck board 30 moves towards the head end of the bed, causing or pulling the seat deck board 36 horizontally towards the head end of the bed. The seat deck board 36 also lowers due to the connectors and more particularly, the seat tubes 62 pivoting about horizontal pivot axes 64 in a counterclockwise direction as shown in FIGS. 2 and 3. The weight of the operator assists the seat deck board to move downwardly also. As the seat deck board moves downwardly and towards the head end of the bed, the leg deck board 38 moves or is pulled from its first horizontal position shown in FIG. 2 to its second inclined position shown in FIG. 3. In this inclined position, the front edge 106 of the leg deck board 38 is lower than the rear edge 108 of the leg deck board 38. This movement of the leg deck board 38 causes or pulls the foot deck board 40 towards the head end of the bed as the connectors and in particular the foot tubes 52 are pivoted about horizontal pivot axes 54 in a counterclockwise direction as viewed in FIGS. 2 and 3. In its inclined position shown in FIG. 3, the front edge 110 of the foot deck board 40 is higher than the rear edge 112 of the foot deck board 40.

As desired, the articulated bed 10 may be moved from its fully inclined position shown in FIG. 3 back to its horizontal position shown in FIG. 2 upon activation of the gas spring 88 and the operator leaning back to assist the head deck board 34 towards its horizontal position.

Although I have described one preferred embodiment of the invention, I do not intend to be limited except by the scope of the following claims.

I claim:

1. An adjustable bed comprising:

a stationary frame;

generally inverted U-shaped foot tubes pivotally secured to said frame;

generally inverted U-shaped seat tubes pivotally secured to said frame;

a deck comprising a head deck board, a seat deck board secured to said seat tubes and hingedly secured to said head deck board;

a leg deck board hingedly secured to said seat deck board;

a foot deck board hingedly secured to said leg deck board and secured to said foot tubes, an inverted U-shaped head tube pivotally secured to said frame and secured to said head deck board; and a driver pivotally secured at its upper end to a mounting bracket secured to the head deck board and pivotally secured at its lower end to a bracket secured to a head end rail of said frame and extending therebetween for moving said deck between a first horizontal position and a second fully inclined position.

2. The adjustable bed of claim 1, wherein said driver is a gas spring.

3. The adjustable bed of claim 1 further comprising supports extending downwardly from said frame.

4. The adjustable bed of claim 1 wherein said driver is remotely controlled.

5. The adjustable bed of claim 1 wherein said seat deck board moves between a forward position and a rear position upon movement of said head deck board.

6. The adjustable bed of claim 1 further comprising clips secured to said head, seat and foot deck boards, said head, foot and seat tubes being secured to said clips.

7. The adjustable bed of claim 1 wherein said seat deck board moves towards a head end rail of said frame and lowers when said head deck board is inclined.

8. The adjustable bed of claim 1 wherein said seat deck board, said leg deck board and said foot deck board each move towards a head end rail of said frame when said head deck board is inclined.

9. An adjustable bed comprising:

a stationary frame;

generally inverted U-shaped foot tubes pivotally secured to said frame;

generally inverted U-shaped seat tubes pivotally secured to said frame;

a seat deck board secured to said seat tubes;

a foot deck board secured to said foot tubes, a leg deck board hingedly secured to said seat deck board and said foot deck board therebetween;

a head deck board hingedly secured to said seat deck board;

an inverted U-shaped head tube pivotally secured to said frame and secured to said head deck board; and a gas spring comprising a cylinder and a piston rod movable inside the cylinder, the gas spring being pivotally joined at its upper end to a mounting bracket secured to said head deck board and the gas spring being pivotally secured at its lower end to a bracket moveable between mounting brackets secured to a head end of said frame, wherein activation of said gas spring moves said head deck board between an inclined position and a flat position.

10. The adjustable bed of claim 9 wherein said seat deck board, said leg deck board and said foot deck board each move when said head deck board is inclined.

11. The adjustable bed of claim 9 wherein said gas spring is remotely controlled.

12. The adjustable bed of claim 9 wherein said gas spring is actuated by a cable and cable release.

13. An adjustable bed comprising:

a stationary frame having a pair of opposed side rails, a head end rail and a foot end rail;

an articulated deck spaced above said stationary frame with connectors, said articulated deck comprising a head deck board, a seat deck board, a leg deck board and a foot deck board hingedly joined to each other, said connectors being pivotally secured to said side rails of said frame and secured to said head, seat and foot deck boards; and a gas spring operatively coupled to a bracket secured to said head deck board at its upper end and pivotally secured at its lower end to an adjustable mounting assembly fixed to the head end rail of the frame, wherein activation of said gas spring causes said seat deck board to move vertically and horizontally and wherein said adjustable mounting assembly includes a rotatable hand wheel for rotating a threaded rod to which is secured a movable bracket.

14. The adjustable bed of claim 13 wherein said frame is supported by legs secured to said frame.

15. The adjustable bed of claim 13 wherein said connectors are inverted U-shaped tubes.

16. The adjustable bed of claim 13 wherein said gas spring is remotely controlled.

* * * * *